US005433268A

United States Patent [19]

Janezich et al.

[11] Patent Number: 5,433,268

[45] Date of Patent: Jul. 18, 1995

[54] RADIATOR CONSTRUCTION

[75] Inventors: Robert J. Janezich, Hibbing; Todd G. Dosen, Side Lake; Charles E. Cedar, Hibbing, all of Minn.

[73] Assignee: L & M Radiator, Inc., Hibbing, Minn.

[21] Appl. No.: 161,913

[22] Filed: Dec. 3, 1993

[51] Int. Cl.[6] ..... F28F 9/04

[52] U.S. Cl. ..... 165/76; 165/175; 165/178

[58] Field of Search ..... 165/76, 173, 175, 78, 165/178

[56] References Cited

U.S. PATENT DOCUMENTS 1,412,056 4/1922 Hughes et al. ..... 165/76
3,391,732 7/1968 Murray ..... 165/76
4,236,577 12/1980 Neudeck ..... 165/175
4,344,478 8/1982 Petaja et al. ..... 165/76 X
5,101,887 4/1992 Kado ..... 165/76
5,348,082 9/1994 Velluet et al. ..... 165/173

*Primary Examiner*—John Rivell
*Assistant Examiner*—L. R. Leo
*Attorney, Agent, or Firm*—Banner & Allegretti, Ltd.

[57] ABSTRACT

An improved radiator construction comprising a cooling tube having a barbed end, preferably with an adjacent collar, spaced apart sufficient to engage an elastomeric seal. The seal and tube are positioned in the opening of a radiator or heat exchanger header so that the tube barb and collar and the engaged seal cooperate to retain the cooling tube in the header.

9 Claims, 4 Drawing Sheets

RADIATOR CONSTRUCTION

BACKGROUND OF THE INVENTION

The present invention relates to a novel, improved radiator construction and in particular, a radiator construction utilizing a unique tube construction which allows for the use of a simple, less expensive seal construction to provide improved tube retention in the radiator.

In heavy duty radiators, particularly radiators used in heavy, earth moving equipment, the core of the radiator is constructed from a series of cooling conduits or heat exchanger tubes attached to and in communication with upper and lower radiator tanks. These tanks receive cooling fluid such as water, with or without antifreeze, as it passes to and from the engine as circulated by a water pump. Cooling fins are typically attached to the cooling conduits to facilitate heat transfer.

It is undesirable to permanently attach or affix the conduits to the radiator tanks because if any one of the heat exchange conduits in the core develop a leak, the entire core must be removed and repaired. This is a particularly vexatious problem in heavy duty earth moving equipment wherein the continued jarring of the equipment and the vibration induced by the engine has a tendency to compromise the connection between the tanks and the heat exchange conduits with the resultant tube movement causing leaks in some applications.

A solution to this problem is illustrated in U.S. Pat. No. 3,391,732 the teachings of which are incorporated by reference herein. U.S. Pat. No. 3,391,732 describes a radiator core constructed from a series of conduits, each of which has either end removably mounted in the framework, or headers, of the radiator which provide a portion of the upper and lower radiator tanks or reservoirs. As illustrated in U.S. Pat. No. 3,391,732, the bottom of each conduit of the radiator core is placed in an elastomeric seal having a shoulder around the outer periphery of the seal. This shoulder, in turn, engages the header plate when the seal is placed in the openings of the header. Positioned in the interior portion of the seal is a radially positioned groove or recess that mates or cooperates with a radially outward extending flange or collar contained in the heat exchange conduit. This seal construction is illustrated in FIGS. 4 and 5 of U.S. Pat. No. 3,391,732. The interrelationship of that seal with the flange of the cooling conduits is illustrated in FIG. 3 of U.S. Pat. No. 3,391,732. This prior art construction is also reproduced in FIGS. 3 and 4 of this application. Referring to FIGS. 3 and 4, the prior art construction includes a header 2 having a circular opening 3 therein. An elastomeric seal 18 is positioned within opening 3 of header 2. The upper portion of seal 18 is formed to provide an elastomeric seal shoulder 14 having a diameter greater than opening 3 so as to prevent the seal from passing downwardly through the opening 3 in header 2. The center portion 16 of seal 18 receives a heat exchange tube having a cylindrical conduit end 8. Cylindrical end 8 of heat exchange tube 1 is maintained in position within seal 18 through the interaction of groove or recess 22 contained in seal 18 and flange or collar 20 extending outwardly from the surface of conduit end 8. Positioned above the cylindrical portion of conduit 8 is a flattened conduit section 4 having affixed thereto heat exchanger fins 6.

The structure described in U.S. Pat. No. 3,391,732 and as illustrated in FIGS. 3 and 4 of this application has, over the years, proven to be a reliable method of providing a removable tube radiator core structure. If one heat exchange tube fails, that tube can be replaced instead of replacing the entire radiator. The elastomeric nature of the seal in combination with the interaction of the collar 20 on the tube and the interior recess or groove 22 in the seal absorb shock and vibration forces and thermal expansion and contraction to maintain the tube in a sealed positioned.

As the art progressed, the materials used in the design of the seals illustrated in U.S. Pat. No. 3,391,732 changed and evolved so as to provide a longer life in the extremes of temperature and chemicals to which such elastomeric seals were exposed in the field. New elastomeric materials were developed which are more resistant to the environment encountered in heavy earth moving equipment but which are also much more expensive. When seals made from these new elastomeric materials were introduced, it was discovered that these materials were more vulnerable to molding problems and seal 18 with its recess 22 were much more difficult to mold. Specifically, to provide a reliable retention of the tube, it is necessary that there be close interaction between the recess or groove in the seal and the flange or collar in the heat exchange conduit engaging that recess. In particular, because of the nature of the current elastomeric materials used to produce seals for the structure shown in U.S. Pat. No. 3,391,732, it became more difficult to insure that the structure was molded with consistent integrity to the intended design dimensions so as to prevent any inadvertent tube movement and subsequent leakage. While it is certainly possible to prepare elastomeric seals as described in U.S. Pat. No. 3,391,732, through existing molding techniques, utilizing fluid and temperature resistant, state-of-the-art polymers, the cost, due to the size of the seal and the rejection rates associated with the production of such seals, has increased and has increased significantly the cost of manufacturing a reliable radiator core construction.

Other prior art structures are illustrated in FIGS. 1 and 2 and FIGS. 5 and 6 accompanying this application. The prior art structure illustrated in FIGS. 1 and 2 utilize an elastomeric seal 12 placed within opening 3 in header 2. An elastomeric seal shoulder 14 prevents the seal from passing through opening 3. Positioned within the central portion 16 of the seal is the cylindrical conduit end 8 of heat exchange tube 1 which in turn is integrally formed with and attached to flattened conduit 4 having attached thereto heat exchange fins 6. A washer 10 is attached to the cylindrical portion 8 of the conduit and interacts with seal shoulder 14 to prevent the heat exchange tube 1 from passing downward into opening 16 of the seal and/or opening 3 in header 2. The structure illustrated in prior art FIGS. 1 and 2 absorbs, in part, vibration forces, and downward impact forces in vertical tube application but there is nothing contained in that structure to prevent the seal 12 or the heat exchange tube 1 from being displaced upward and out of the seal or sideways out of the seal in horizontal applications. As a result, a safe, reliable seal is not consistently achieved.

Another prior art structure is illustrated in FIGS. 5 and 6 of this application. As illustrated in these Figures, an elastomeric seal 24 is positioned within opening 3 in header 2 and adapted to receive the cylindrical portion 8 of heat exchange conduit 1. Seal 24 has an outwardly extending shoulder 14 extending beyond opening 3 so as to prevent the seal from passing downwardly through opening 3 in header 2. Inwardly extending projections 26 extend inward towards the center portion 16 of seal 24 and are adapted to engage the bottom of cylindrical end 8 of tube 1 so as to control it from passing further downward through the center portion 16 of seal 24. As in case of the structure illustrated in FIGS. 1 and 2, this structure does not retain the cooling conduit 1 in position in a manner designed to prohibit the conduit from rising upwardly out of opening 16 or to otherwise move within that opening. This movement can result in leakage. In addition, the projections 24 do not provide reliable mechanism for preventing the conduit 8 from moving within the center section 16 of seal 24. This movement can also lead to undesired, unexpected leaks. Further, these seals, because of their size, require more material to construct them and because of the projections, are somewhat complex to make. Finally, this structure is more vulnerable to dimensional changes.

SUMMARY OF THE INVENTION

It is the object of this invention to provide a heat exchanger or radiator construction which provides improved retention of the heat exchange tubes within the overall radiator construction.

It is another object of the invention to provide a heat exchanger or radiator construction which does not require close dimensional tolerances within the core and is not vulnerable to deflections, or movements, in the radiator header plates.

It is a further object of this invention to provide a combination of a tube construction and seal for a heat exchanger or radiator assembly that permits the utilization of a simple seal design with reduced material that can be produced on an economical scale with a minimum waste of goods which do not tear or otherwise do not meet specification.

It is another object of this invention to utilize a simple seal design that interacts with a specifically designed tube construction that can be produced readily by conventional molding techniques and which permits the utilization of materials that are otherwise not readily suitable for use in preparing a molded seal having a more complex design.

These objects are satisfied through the heat exchanger or radiator core assembly of the present invention. This core assembly comprises a first and second header spaced apart from each other. Positioned in each header are a plurality of openings typical circular in shape. A seal with an axial opening through the seal is placed in one, if not both, headers. One end of the seal contains an outwardly extending shoulder having a size, or diameter, greater than the opening in the header. The shoulder is spaced apart from the other end of the seal a distance sufficient to permit the seal to be positioned in a header opening while the shoulder engages the surfaces surrounding that opening so as to prevent the seal from moving through that opening during installation of the seal or the tube into the seal. Positioned in the opening of the seal is a heat exchange conduit, one end of which terminates in a barb, preferably a barb having a frustoconical shape, to facilitate the insertion of the heat exchange conduit through the axial opening in the seal. The barb is positioned through the axial opening of the seal of one header and the other end of the tube, typically free of barbs, is positioned in the other header, preferably with an elastomeric seal identical to the seal holding the barbed end in the first header.

In a particularly preferred embodiment, each heat exchange conduit has an outwardly extending collar or flange positioned around the outer periphery of the conduit and spaced relative to the barb sufficient to properly engage the seal so as to prevent movement of the conduit in or out relative to the seal and the header. This collar can be integrally formed in the conduit or it can comprise an outwardly extending flange, such as a washer, attached to or positioned on the outside perimeter of the conduit. Alternatively, a spacer can be positioned over the conduit between the shoulder of the seal and any outwardly extending surface on the heat exchange tube such as a flattened or tinned heat exchange surface so as to prevent movement between the heat exchange conduit, seal and the header. Preferably the axial opening in the seal is substantially free of grooves that engage protrusions extending from the heat exchange tube. A substantially smooth, continuous opening can be used but is not necessary.

These and other objects, advantages and feature of the invention are described in further detail in the detailed description of the invention set forth below.

DETAILED DESCRIPTION OF THE INVENTION

A preferred embodiment of the present invention is illustrated in detail in FIGS. 7–10. Basically the structure illustrated in FIGS. 7–10 is intended to be used in the same basic overall structure illustrated in U.S. Pat. No. 3,391,732 the teachings of which are incorporated by reference herein. The structure illustrated in FIGS. 7–10 of this application differ from that which is described in U.S. Pat. No. 3,391,732 in the shape of the end of the heat exchange conduit placed in that seal and the specific structure of the seals used typically at the bottom of the radiator assembly to attach the heat exchange conduit to the bottom header. In the preferred embodiment of the present invention, the top of the heat exchange tubes are substantially smooth, free of barbs and are connected to the top header of the radiator basically in the same manner as described and illustrated in U.S. Pat. No. 3,391,732. It is for this reason that only the bottom portion of the heat exchange tube 1 and its relationship to the bottom header frame and seal are illustrated in the FIGS. 7–10 of this application. It should be noted that for some applications the detail shown as the "bottom" may be at the top or side, depending upon the orientation of the heat exchanger or radiator.

Figure 1:
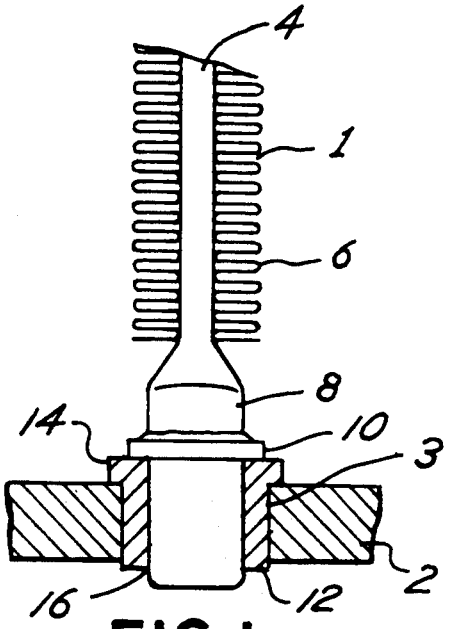
FIG.1 (PRIOR ART)
FIGS. 1 and 2 are front and side sectional views respectively of a prior art radiator structure.
Figure 2:
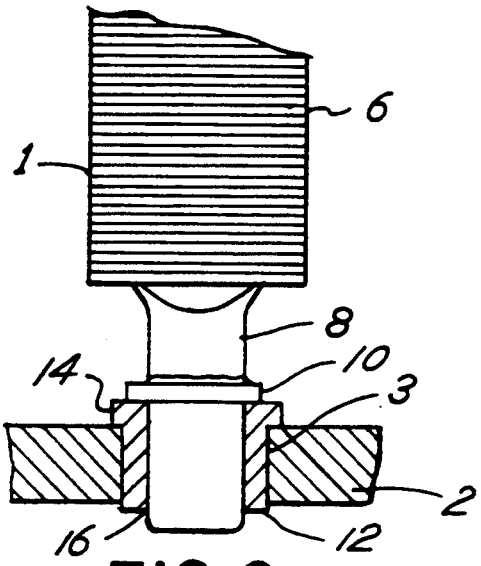
FIG.2 (PRIOR ART)
Figure 3:
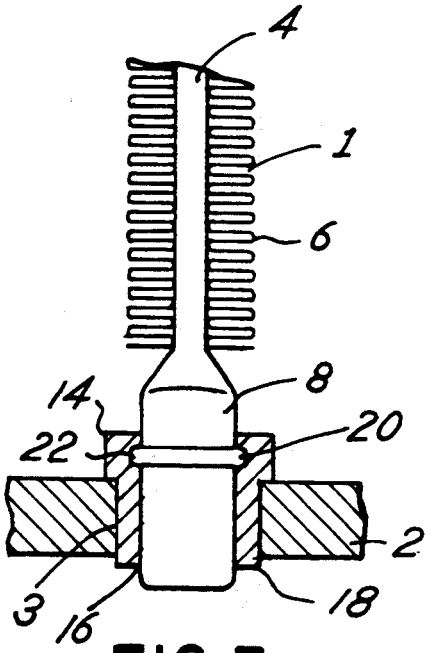
FIG.3 (PRIOR ART)
FIGS. 3 and 4 are front and side sectional views respectively of a preferred prior art radiator construction.
Figure 4:
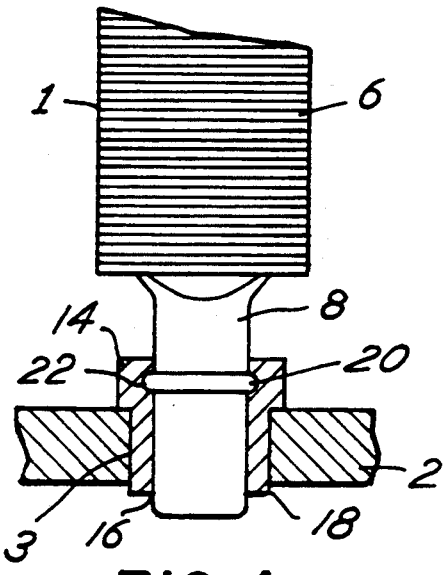
FIG.4 (PRIOR ART)
Figure 5:
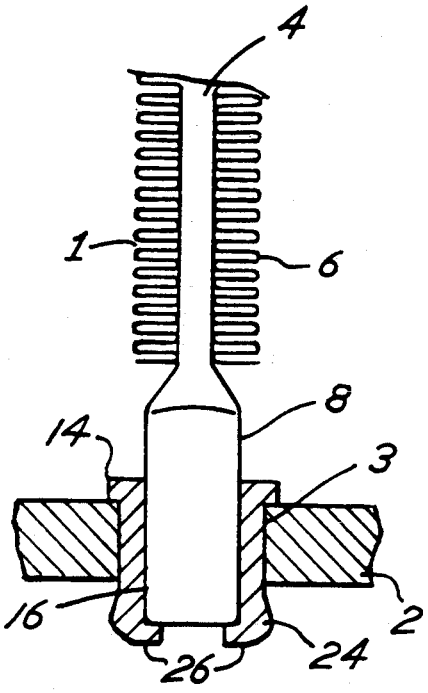
FIG. 5 (PRIOR ART)
FIGS. 5 and 6 are front and side sectional views respectively of yet another prior art radiator structure.
Figure 6:
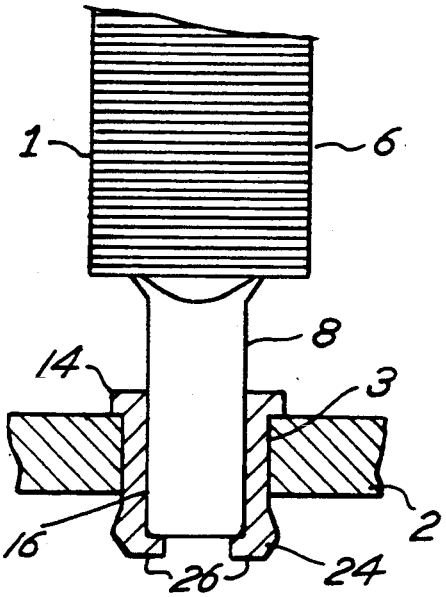
FIG.6 (PRIOR ART)
Figure 7:
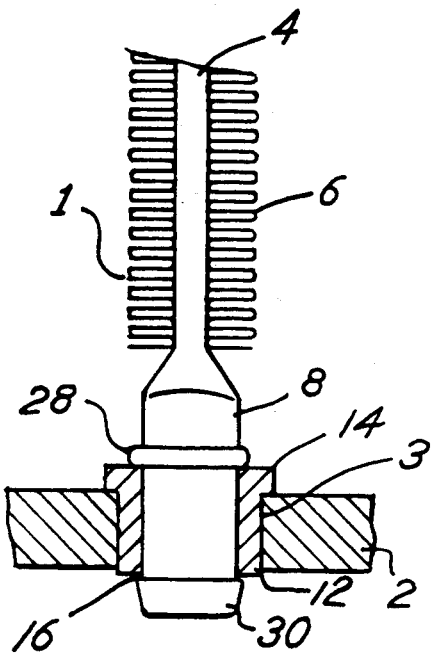
FIGS. 7 and 8 are front and side sectional views respectively of a preferred embodiment of the present invention showing the interrelationship between the heat exchange tube and seal.
Figure 8:
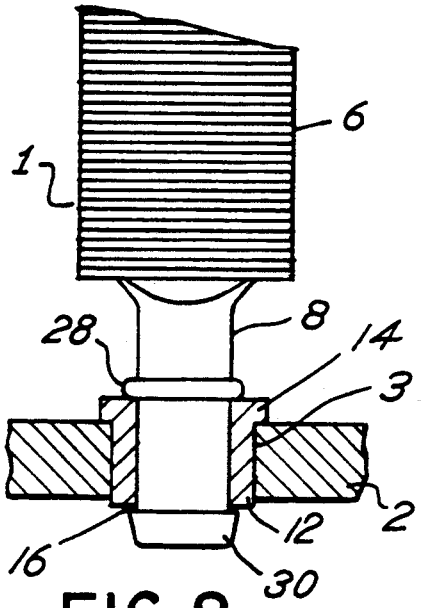
Figure 9:
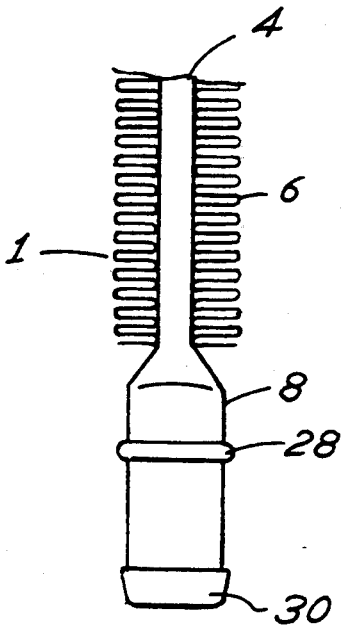
FIGS. 9 and 10 illustrate the specific heat exchange tubes otherwise illustrated in FIGS. 7 and 8 respectively.
Figure 10:
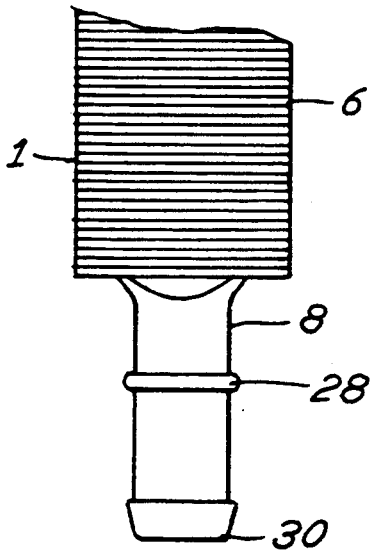

Referring to FIG. 7, there is illustrated a header 2 having an opening 3 therein which receives an elastomeric seal 12 having a shoulder portion 14 which extends beyond opening 3 and contacts the surface surrounding opening 3 so as to prevent the seal from passing downward through opening 3 during seal or tube installation. The heat exchange tube is positioned within the smooth center portion 16 of the seal by passing barbed end 30, which preferably is, as illustrated, of a frustoconical shape, downwardly through the center 16 of the seal. A collar 28 extends outwardly from conduit 8, which is preferably circular in cross section. As illustrated, seal 12 has a thickness substantially the same as the distance between the back side of barb 30 and the interior edge of collar 28. This structure provides benefits not otherwise obtainable in the prior art structure. Specifically, the engagement of the backside of barb 30 with the bottom of seal 18 and the engagement of collar 28 with the top of the simple seal shoulder 14 provides a firm engagement between the heat exchange tube and the seal and header plate so that the tube position is reliably maintained and to provide a firm, reliable, assembly. A preferred embodiment of this invention uses a very similar seal as the prior art shown in FIGS. 1 and 2 but, because of the tube structure, retains the tube in both an up and down or left and right direction as the case may be. Further, the interior center portion 16 of the seal is preferably free of grooves which are difficult to cast or otherwise mold. As a result seal 18 can be readily manufactured from a wide variety of polymers and elastomers with a minimum of waste due to splitting or non-conforming dimensional specifications. Preferably seal 18 is manufactured from a formulation utilizing a fluorocarbon polymer manufactured and sold by dupont under the tradename VITON. These polymers are also generally referred to as FKM polymers and provide a polymeric composition that can be readily molded to form seals in the simple shape illustrated yet are exceptionally resistant to the fluids and high temperature environment found in the engine compartments of heavy duty construction equipment. The specific barbed tube used in this invention also provides reliable retention with the smaller, lower material content seal and therefore can be produced at a lower cost.

The opposite end of heat exchange tube is free of barbs and is positioned in a top header utilizing the same seal as used in bottom header 2. This is a further potential advantage over the prior art since this eliminates the potential for wrong seals being placed in the wrong header opening since the same seals are used at each end of the tube.

Figure 11:
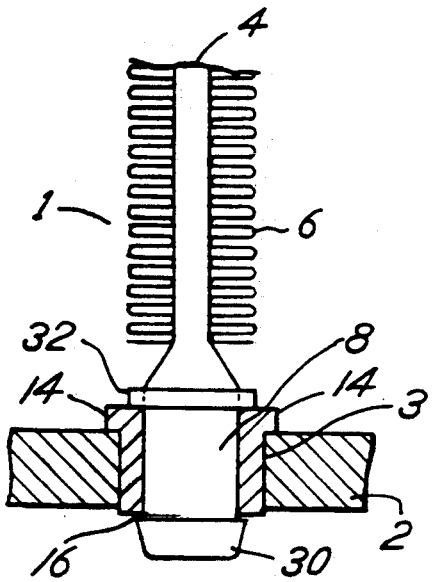
FIGS. 11 and 12 are front and side sectional views respectively of an alternative embodiment of this invention.
Figure 12:
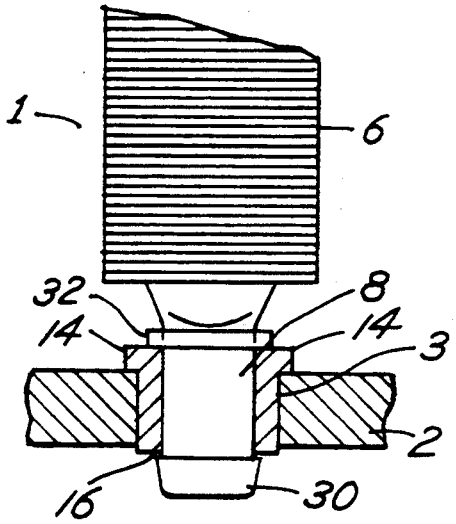

An alternative embodiment is illustrated in FIGS. 11 and 12. The structure illustrated in FIGS. 11 and 12 is basically the same as and performs the function of the structure described in connection with FIGS. 7–10. The structure in FIGS. 11 and 12 utilize instead of an integrally formed collar 28, a washer 32. Washer 32 can be soldered or otherwise attached to the outer surface of cylindrical conduit 8. Alternatively, washer 32 can be positioned over conduit 8 so that it contacts the flare in flattened conduit 4 to hold the tube 1 in position. In any event, washer 32 and the back side of barb 30 interact to hold the tube in place in the seal/header assembly in the same way that the back surface of barb 30 and collar 28 hold the tube in place in conjunction with FIGS. 7–10.

Figure 13:
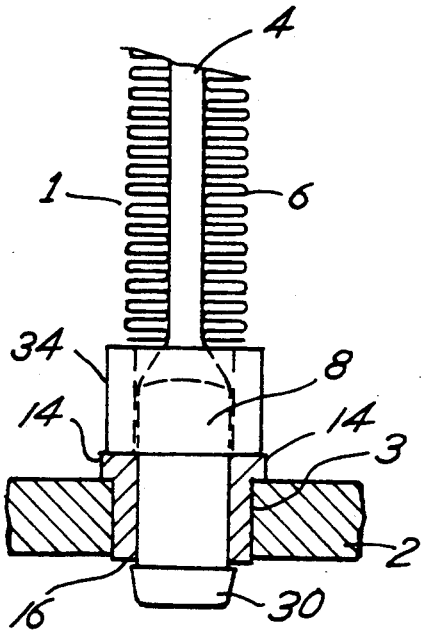
FIGS. 13 and 14 are front and side sectional views respectively of a still further alternative embodiment of the present invention.
Figure 14:
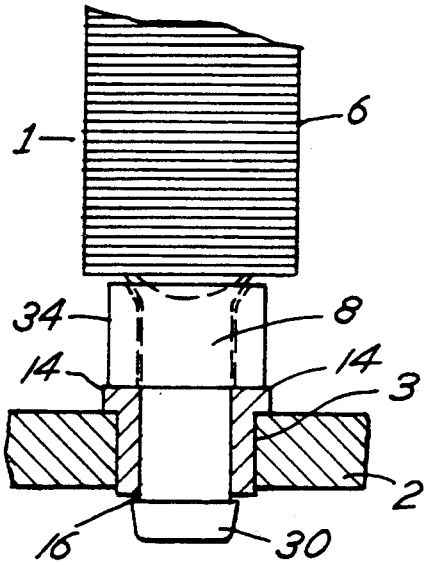

A still further alternative embodiment of the present invention is illustrated in FIGS. 13 and 14. The embodiment illustrated in FIGS. 13 and 14 differ from the embodiments illustrated in FIGS. 7–10 and FIGS. 11–12 in that an elongated cylindrical spacer 34 is placed between the top of seal shoulder 14 and the heat exchange fins 6 and/or the flattened conduit 4 to prevent relative downward/inward movement between the heat exchange conduit and the seal/header assembly. The seal and barbed tube end are otherwise identical to those illustrated in FIGS. 7–12. Specifically, the cylindrical spacer 34 performs the function of the washer 32 or integrally molded collar 28 in conforming with the back side of barb 30 to prevent inadvertent tube movement with the additional function of providing a baffle to block undesirable air leakage.

This invention has been described with respect to specific preferred embodiments is exemplified in the Figures. It will be understood, however, that the present invention is not limited to the specific examples illustrated and that it can be practiced in various alternative modes within the scope of the following claims. For example, the present invention can be utilized with flat, flattened, round or tinned radiator tubes as well as with round heat exchanger tubes.

We claim as our invention:

1. A radiator core or heat exchanger assembly which comprises:

(a) a first header;

(b) a second header, spaced apart from the first header;

(c) each header having a plurality of header openings therein;

(d) a seal positioned in the header openings of at least one of the headers, each seal having an axial opening therethrough;

(e) a plurality of heat exchange conduits, each conduit having a longitudinal axis, a predetermined outside diameter and one barbed end positioned through the axial opening of the seal and the other end positioned in the other header so as to provide a radiator core assembly, wherein the barbed end and the seal are cooperatively positioned to engage the seal within the header opening and to control movement of the conduit within the header;

(f) the barbed end of each heat exchange conduit having a frustoconical shape defining a back segment having a back diameter greater than the predetermined outside diameter and a front segment having a front diameter substantially equal to the predetermined outside diameter to facilitate insertion of the heat exchange conduit into and through the seal;

(g) the back segment of the barbed end further defining a shoulder substantially perpendicular to the longitudinal axis of the heat exchange conduit to engagingly support the seal thereon.

2. A radiator core assembly as in claim 1 wherein the axial opening of the seal is substantially free of grooves so as to provide a substantially smooth, continuous opening.

3. A radiator core assembly as in claim 2 wherein each heat exchange conduit has an outwardly extending collar around the outer periphery of the conduit, the collar positioned to engage the outside surface of one end of the seal to prevent movement of the conduit into the seal and the header.

4. A radiator core assembly as in claim 3 wherein the collar is integrally formed in the conduit.

5. A radiator core assembly as in claim 3 wherein the collar comprises an outwardly extended flange positioned on the outside perimeter of the conduit.

6. A radiator core as in claim 3 wherein the thickness of the seal is substantially equal to the distance from the conduit flange to the barbed end.

7. A radiator core assembly as in claim 1 wherein each heat exchange conduit has an outwardly extending surface projecting outwardly from a portion of the conduit, and a spacer positioned over the conduit between the seal and the outwardly extending surface so as to prevent movement between the heat exchange conduit, the seal and the header.

8. A radiator core assembly as in claim 7 wherein the spacer is a cylindrical body.

9. A radiator core assembly as in claim 1 wherein an identical seal is positioned in the openings of both the upper header and the lower heads.

* * * * *